US005220768A

United States Patent [19]

Aarts

[11] Patent Number: 5,220,768

[45] Date of Patent: Jun. 22, 1993

[54] METHOD AND APPARATUS FOR MAKING A VACUUM-PACKAGE FILLED WITH GRANULAR MATERIAL

[75] Inventor: Mathias L. C. Aarts, Bilthoven, Netherlands

[73] Assignee: Sara Lee/DE N.V., Netherlands

[21] Appl. No.: 754,404

[22] Filed: Sep. 3, 1991

[30] Foreign Application Priority Data

Sep. 4, 1990 [NL] Netherlands ..... 9001945

[51] Int. Cl.[5] ..... B65B 31/04

[52] U.S. Cl. ..... 53/405; 53/86; 53/434; 53/436; 53/512; 53/526

[58] Field of Search ..... 53/86, 405, 434, 436, 53/510, 512, 523, 526, 527

[56] References Cited

U.S. PATENT DOCUMENTS

| | | | |
|---|---|---|---|
| 2,241,943 | 5/1941 | Berch . | |
| 2,481,611 | 9/1949 | Moore | 53/526 X |
| 2,601,020 | 6/1952 | Hopp . | |
| 3,488,914 | 1/1970 | Csernak | 53/551 X |
| 3,488,915 | 1/1970 | Delestatius | 53/526 X |
| 3,545,983 | 12/1970 | Woods . | |
| 4,292,786 | 10/1981 | Long et al. | 53/434 |
| 4,457,122 | 7/1984 | Atkins et al. | 53/512 X |
| 4,706,441 | 11/1987 | Chervalier | 53/512 |
| 4,727,706 | 4/1988 | Beer | 53/434 |
| 4,734,292 | 3/1988 | Gerardus Van Baxtel | 53/434 X |
| 4,845,927 | 7/1989 | Rapparini | 53/512 X |

FOREIGN PATENT DOCUMENTS

| | | | |
|---|---|---|---|
| 249340 | 8/1962 | Australia | 53/436 |
| 89309081.1 | 7/1989 | European Pat. Off. . | |
| 2519774 | 2/1975 | Fed. Rep. of Germany . | |
| 2397330 | 7/1977 | France . | |
| 317417 | 12/1988 | Japan | 53/405 |

*Primary Examiner*—John Sipos
*Assistant Examiner*—Daniel Moon
*Attorney, Agent, or Firm*—Merchant, Gould, Smith, Edell, Welter & Schmidt

[57] ABSTRACT

The invention relates to a method for making a vacuum-package filled with granular material. In this method, the package filled with granular material and made from a thin-walled and flexible packaging foil is placed in a holder surrounding the bottom and sidewalls of the package and comprising flat, parallel walls, and a vacuum is applied to the contents of the package and the package is subsequently vacuum-sealed hermetically. According to the invention, the contents of the package, during at least a part of the evacuation step, are compressed by moving the flat and parallel walls of at least one pair of opposite sidewalls of the holder toward each other in mutually parallel manner against the package. The invention further relates to an apparatus for use in the invention.

15 Claims, 3 Drawing Sheets

METHOD AND APPARATUS FOR MAKING A VACUUM-PACKAGE FILLED WITH GRANULAR MATERIAL

The invention relates to a method for making a vacuum-package filled with granular material, in which the package filled with granular material and made from a thin-walled and flexible packaging foil is placed in a holder surrounding the bottom and sidewalls of the package and comprising flat, parallel walls, and in which a vacuum is applied to the contents of the package and the package is subsequently vacuum-sealed hermetically.

Such a method is known from U.S. Pat. No. 4,845,927 describing a method in which a package open at the top is formed from flexible foil supplied in sheet form, the package being arranged in a holder for support. The open package in the holder is filled with the granular material, whereafter the holder with the package is made to vibrate by means of a vibrating member to achieve an even distribution of the loose granular material in the package. Then a die is applied to the contents for compacting the granular material in the package. After removal of the die, the package passes a vacuumizing station, where a vacuum is applied to the contents of the package by removing through suction the gases present therein. While passing through the vacuumizing station, the package is sealed after the desired level of vacuum has been reached.

A disadvantage of the vacuum-package so formed is that its external surface is not flat and smooth. This disadvantage occurs in spite of the fact that the package is made from smooth packaging foil and the package is supported in the holder. The problem arises because during vacuumizing the thin packaging material is drawn against the granules and thereby acquires a granular like appearance. Moreover, vacuumizing often leads to irregularly shaped wrinkles in the package.

This unsmooth appearance of the package is undesirable from an esthetic point of view. A further drawback thereof is that any text printed on the package is difficult to read. Further, the granular surface of the package is susceptible to damage, which is particularly unacceptable with vacuum-packages because even the slightest perforation in the package results in the loss of the vacuum.

To overcome these drawbacks, often a second package is provided around the vacuum-package. Because the space between the two packages remains under atmospheric pressure, the outer package is not drawn tightly against the granular contents of the package in the way the inner package is and therefore remains flat.

Another solution is proposed in European patent specification 361,711, namely the use of a single package which, however, is composed of two separate layers of material. The two layers are locally connected with each other but otherwise separate. The inner layer is drawn tightly against the granular contents of the package. The space between the two layers remains in communication with the atmosphere, so that the outer layer remains flat.

The use of a double package or a package made from a laminate composed in a particular manner is expensive on account of the material costs as well as the costs of production.

The same objection applies to using a thicker foil material to thereby reduce the extent of unevenness on the package.

It has also been proposed to make the structure of the package less granular by producing only a low level of vacuum in the package. This solution, however, is unacceptable if the product to be packaged requires a high level of vacuum. One example that is mentioned is the vacuum-packaging of ground coffee, which should be carried out at a high level of vacuum, for instance 50 mb, to ensure that even after a longer time, when the coffee still releases gases, a sufficiently reduced pressure is maintained in the package.

SUMMARY OF THE INVENTION

It is an object of the invention to provide a method for making a vacuum-package filled with granular material, by which method a relatively smooth surface of the pack can be obtained in simple manner, even when a single thin packaging foil is used.

To that effect, the invention provides a method for making a vacuum-package filled with granular material, in which the package filled with granular material and made from a thin-walled and flexible packaging foil is placed in a holder surrounding the bottom and sidewalls of the package and comprising flat, parallel walls, and in which a vacuum is applied to the contents of the package and the package is subsequently vacuum-sealed hermetically, characterized in that the contents of the package during at least a part of the evacuation step are compressed by moving the flat and parallel walls of at least one pair of opposite sidewalls of the holder toward each other in mutually parallel manner against the package.

The invention further provides an apparatus for making a vacuum-package filled with granular material, comprising a holder provided with flat, parallel walls, which holder surrounds the bottom and sidewalls of a package placed therein and filled with granular material, which package is made from thin-walled and flexible packaging foil, a vacuum means for applying a vacuum to the contents of the package and sealing means for vacuum-sealing the package hermetically, characterized in that the flat and parallel walls of at least one pair of opposite sidewalls of the holder can be moved relative to each other toward each other for compressing during at least a part of the evacuation step the contents of the package placed in the holder.

According to the invention, during evacuation one or more pairs of opposite flat sidewalls of the holder are pressed against the filling of the package. In the method according to the above-mentioned U.S. Pat. No. 4,845,927, for the purpose of compacting the filling, the filling in the open package is only compressed from above. This downward pressure is effected and terminated before the package is evacuated. The holder is not formed with sidewalls that can be moved toward each other.

Owing to the granular nature of the filling, compression thereof in a vertical direction will have little effect in directions perpendicular to the vertical direction, certainly so if the pressure in vertical direction is relatively slight as for compacting the filling in an open package. According to the invention, the sidewalls of the holder are pressed against the corresponding sidewalls of the package at a relatively high pressure of the order of 2–4 bar, so that the sidewalls of the package become flat.

During evacuation, the pressure in the package should be maintained at least until the contents of the package have become sufficiently rigid for the package not to change its shape any more after removal of this pressure. Evacuation can commence simultaneously with or after the initiation of compression of the package. If desired, compression can be started shortly after evacuation has been initiated, as long as the contents of the package are still compressible.

As packaging foil, the conventional materials can be chosen. The invention does not require the provision of a second package around the first. The foil to be used in the invention can be a laminate such as paper with a layer of aluminum deposited thereon by evaporation. However, as the separate layers of a laminate are often difficult to separate after the package has been used, such a laminate is less attractive on environmental grounds. An advantage of the invention is that also a thin-walled single foil can be used of a material that is degradable after use or a recoverable material, for instance thin aluminum foil.

The invention is well suited for packaging many kinds of granular material. The invention is particularly suited for vacuum-packaging ground coffee. Also composite granular materials such as dried soup can be vacuum-packaged in accordance with the invention with the packages having smooth walls.

The surface of the vacuum-package obtained according to the invention is characteristic. In the known vacuum-packages, the surface of the (primary) package exhibits little bumps and pits, i.e. unevenness in two opposite directions. In contrast, the package according to the invention exhibits a flat wall in which any unevenness that may occur is exclusively directed toward the interior of the package, in the form of minor pits.

Preferably, the walls of both pairs of opposite flat sidewalls of the holder are moved toward each other in the manner described. Thus, all sidewalls of the normally rectangular package are pressed flat. Optionally, the package can in addition be compressed in vertical direction, for instance by moving the bottom of the holder toward a support member arranged at the top of the package concurrently with the sidewalls being moved toward each other. In this way, the package can be compressed on all sides.

During compression of the package, opposite sidewalls of the holder are moved toward each other. For that purpose the walls of the holder can be formed as individual plates which can be moved back and forth over a distance of, for instance, some millimeters, in mechanical, pneumatic or any other suitable manner. As noted, it is possible to move the bottom of the holder toward a support member arranged at the top of the package concurrently with the displacement of the sidewalls of the holder toward each other.

Preferably, when the package is to be compressed, it has already been folded up at the top. A small opening may still be left, for instance in the form of a narrow split at the top of the package, for the discharge of air from the package. After compression, during evacuation, the package can then be sealed hermetically in known manner by means of sealing jaws 100.

Alternatively, it is also possible to seal the package hermetically prior to compression. In that case, the package must comprise an outwardly opening retaining vent valve through which air and any other gases can escape from the package during compression and evacuation thereof.

Compression is preferably effected by arranging the holder in a thin-walled bag-shaped casing, followed by supplying compressed air externally of the casing, so that the casing presses the sidewalls and the bottom of the holder inwardly against the package. The holder can be arranged in the casing as a loose holder with the package disposed therein, but the holder can also be permanently affixed in the casing on the inside thereof.

The casing can be arranged in a rigid bell or chamber accessible at one end for arranging the package or the holder with package in the casing. After the package has been arranged in the casing, the chamber is closed hermetically by means of an end plate, whereby the space enclosed by the bag-shaped casing in the chamber is also closed off from the rest of the space in the chamber. The space within the casing, in which the package is disposed, is connected to a vacuum pump for evacuating the contents of the package. When the casing is still at rest at the outset of the evacuation step, the casing with holder, as a result of evacuation, will already to a slight extent be pressed against the package by the external atmospheric pressure. A compressed air line is connected to the chamber for supplying compressed air externally of the casing and the resultant firm compression of the contents of the package. A pressure of the order of 2–4 bar will normally be sufficient. The casing can be designed as a single bag but also as a double-walled bag, in which case the air line is connected to the space between the two walls thereof. Then, upon supply of air, the bag is as it were inflated between the inner wall of the rigid chamber and the package.

The bag presses the sidewalls of the holder inwardly, so that the contents of the package are compressed. At the same time the bag pushes the bottom of the holder inwardly, with the end plate of the chamber at the open end of the holder serving as a support member.

The sidewalls and the bottom of the holder are preferably connected to each other, of course in a manner permitting mutual relative movement, for instance by means of hinges, rubber bands or springs.

Optionally, the finished vacuum-package can be directly checked for leaks while it is still in the rigid chamber. For that purpose, the casing with holder is still retained against the package. If the casing has already withdrawn, it is pressed against the package again. The very little residual space that remains between the casing with holder and the package is now brought into communication with the atmospheric ambient air. Then this space is closed off from the ambient air again. For a predetermined time, for instance 10 seconds, the pressure in the residual space is measured as a function of time. If the package does not leak, the pressure in this space will hardly change, if at all. However, if a pressure drop occurs which is greater than a threshold value which has been determined in practice, this is an indication that the package leaks. Owing to the very slight volume of the residual space relative to the space between the granules in the package, even a small perforation in the package will become manifest as a considerable pressure drop.

This possibility of combining in one and the same apparatus the production of the vacuum-package and the testing of the package for leakage is a further important advantage of the invention.

BRIEF DESCRIPTION OF THE DRAWINGS

The invention will be further explained and illustrated, by way of example, with reference to the accompanying drawings, in which.

DESCRIPTION OF THE PREFERRED EMBODIMENT

Figure 1:
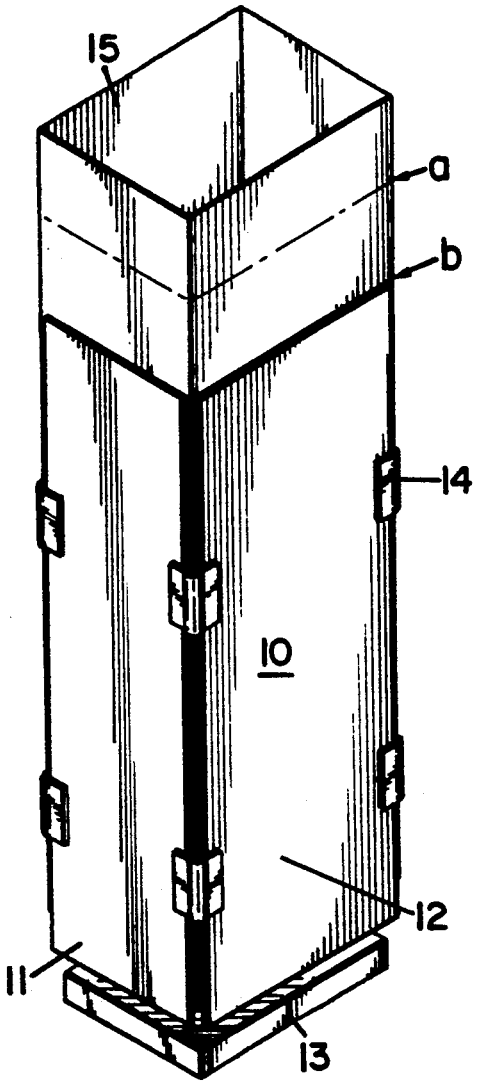
FIG. 1 shows a holder with walls adapted to move toward each other for use in the invention, having arranged therein a package which is open at the top.
Figure 2:
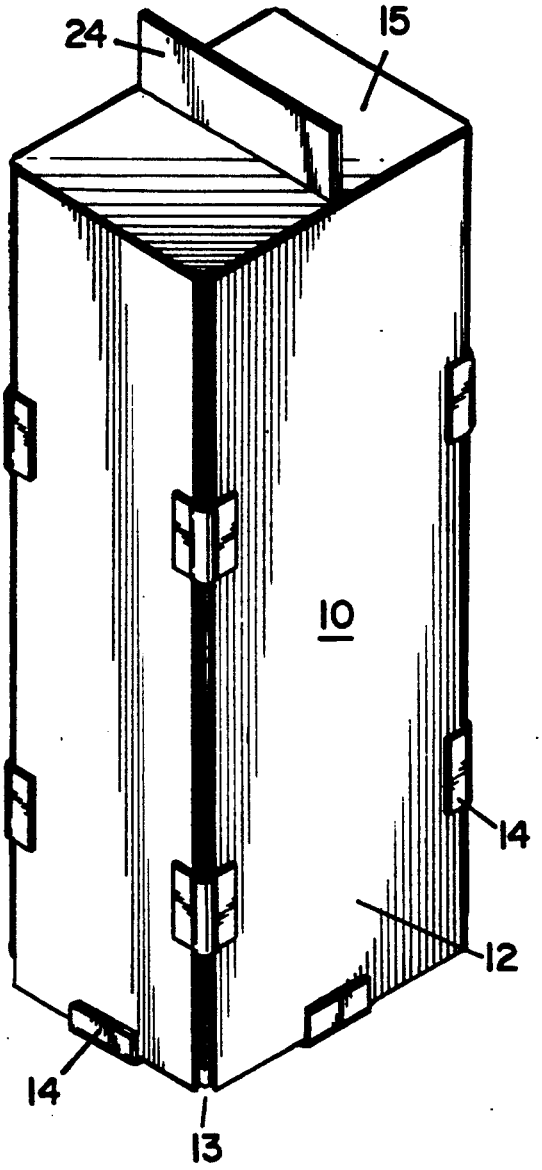
FIG. 2 shows the holder of FIG. 1 after the package has been folded shut at the top.

FIG. 1 shows a holder 10 comprising a pair of parallel rectangular rigid and flat plates 11 and a second pair of similar plates 12. The plates 11 and 12 enclose a space of rectangular section. Adjacent plates 11 and 12 are connected to each other by means of springing hinges 14. Each hinge 14 consists of two plates which are fixedly connected to a plate 11 or 12 and connected to each other through a springing or other suitable flexible connecting piece. The hinges permit slight displacement in mutually perpendicular directions of the plates coupled by a hinge. Disposed between the lower end of the plates 11, 12 is a rigid and flat bottom plate 13 of the holder. As shown in FIG. 2, the bottom plate is affixed to the lower ends of plates 11, 12 by means of hinges 14 which are similar to those between plates 11, 12 (FIG. 1 shows the bottom plate 13 before it has been mounted in the holder and without hinges). The hinges permit a slight displacement of the bottom plate 13 in vertical direction between the four plates of the holder.

The dimensions of the holder are such that a preformed package 15 can be arranged therein, preferably with a little clearance, the lower end of the package coming to rest on the bottom plate 13.

Figure 3:
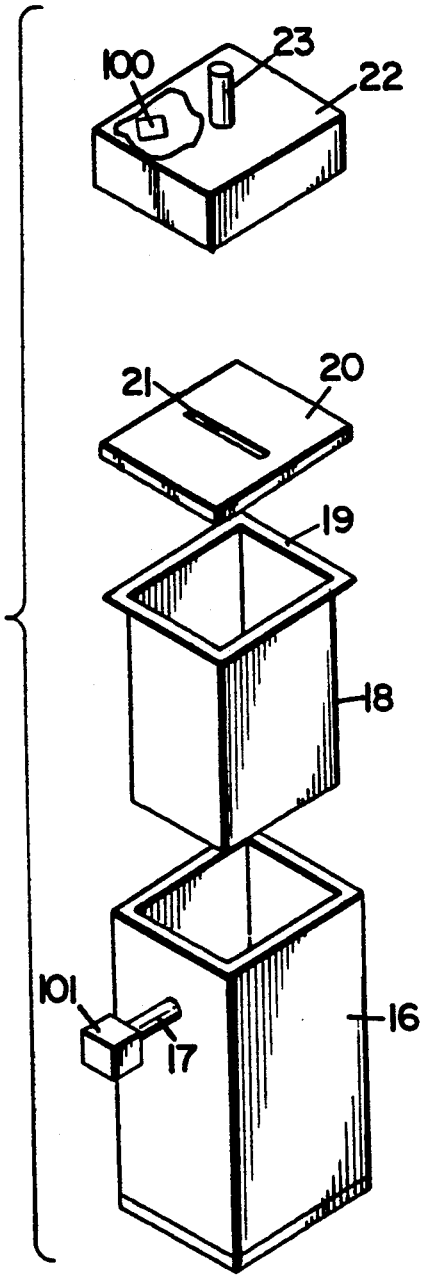
FIG. 3 shows a box-like chamber, above which are shown, successively, a bag-shaped casing, a cover, and a vacuum member for use in the invention.

FIG. 3 (bottom part) shows a rigid rectangular chamber 16, closed at the bottom and open at the top. Provided on the external wall of the chamber is a connection 17 for the supply of compressed air 101 to the interior of the chamber. A correspondingly shaped thin-walled and flexible bag 18, made of rubber, for instance, fits into the chamber, preferably with little clearance. When arranged in the chamber, the bag has a flange-shaped upper edge 19 resting on the flat upper edge of the chamber, the bottom of the bag resting on the bottom of the chamber. The bag can be removable or may be permanently mounted in the chamber. The edge 19 of the bag also serves as an airtight seal between the upper edge of the chamber and a cover 20 to be placed on the chamber, which cover 20 has a slotted aperture 21 provided therein. Finally, a vacuum member 22, provided with a connection 23 for a vacuum pump, can be mounted hermetically on the cover 20.

In practicing the invention, for instance for making a 250 gram vacuum-package with ground coffee, the empty, preformed package 15 is fitted into the holder 10 until the bottom of the package abuts the bottom plate 13 of the holder. The upper part of the package extends above the upper end of the holder. Then the package with ground coffee is filled to level "a" (FIG. 1). If so desired, rather than an empty package, a package that has already been filled to level "a" can be arranged in the holder. The holder with the filled package arranged therein is now subjected to a vibratory movement so that the level of the filling drops to level "b", i.e. level with the upper edge of the holder 10.

The upper end of the package is now folded up, so that a horizontal upper surface is obtained with an upright edge 24 in the middle thereof. Although the package is now folded up, the closure is not yet airtight since air can still flow from the interior of the package between the walls of the upright edge 24.

The holder with package as shown in FIG. 2 is now ready to be placed in the bag 18 which has previously been placed in or affixed to the chamber 16. The dimensions of the holder 10 and the bag 18 are preferably such that the holder with the package can easily, but with little clearance, be fitted into the bag, the bottom of the holder coming to rest on the bottom of the bag. The upper edge of the holder, and hence the flat portion of the upper end of the package, end up level with the upper edge of the chamber, having disposed thereon the flat edge 19 of the bag.

Figure 4:
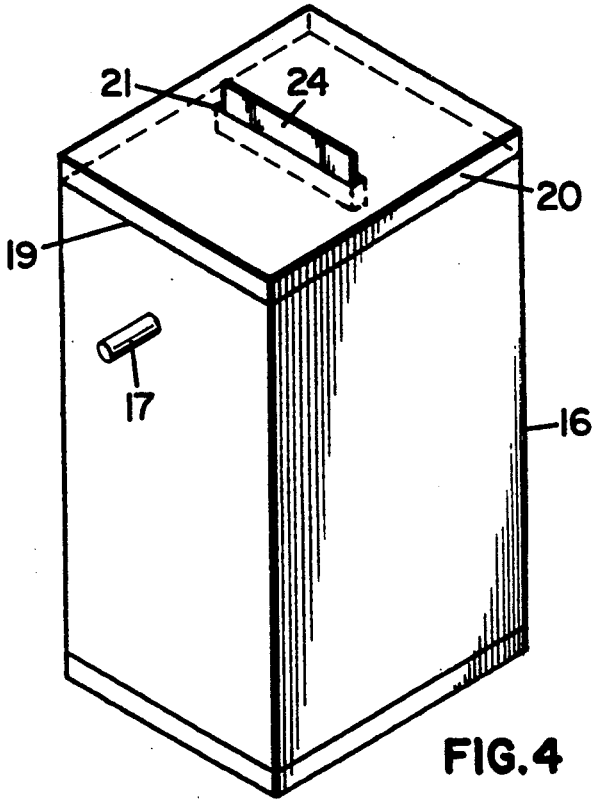
FIG. 4 shows the chamber with cover of FIG. 3 after the bag-shaped casing and holder with package according to FIG. 2 have been arranged therein.

The chamber can now be closed at the top by means of the cover 20. The underside of the cover is disposed in abutment with or close to the top surface of the package. The upright edge 24 of the package extends through the slotted aperture 21 in the cover. This situation is shown in FIG. 4.

Finally, the vacuum member 22 with airtight seal is placed on the cover 20.

The arrangement is now ready for the supply of compressed air via connection 17 into the closed off space between the internal wall of chamber 16 and the external wall of the bag 18. As a result, the bag will have its internal wall pressed against the walls and bottom of the holder, for instance at a pressure of 2 bar. As a result thereof, the plates 11 and the plates 12, respectively, are moved toward each other and thereby pressed against the package in the holder, the contents of the package thus being compressed in two horizontal directions. During the movement of the plates 11, 12, the bottom plate 13 of the holder is pushed through the bottom of the bag. The upper surface of the package rests or comes to rest against the underside of the cover 20 which serves as a support member in this operation. Thus, the package is also compressed in vertical direction, i.e. on all sides. During compression, which is accompanied by a reduction of the volume of the package, air can escape from the package via the upright edge 24.

Concurrently or approximately concurrently with the supply of compressed air through connection 17, the interior of the package is vacuumized by means of a vacuum pump connected to connection 23. In this way, too, air escapes from the package via the edge 24.

The pressure on the outside of the compressed package is maintained at least until the package has become rigid as a result of evacuation by suction. In practice, normally the pressure mentioned will be maintained until the level of vacuum desired for the package, for instance about 50 mbar, has been reached. At that time, by means of a pair of thermoelectric sealing jaws mounted in the vacuum member, the edge 24 of the package is sealed so that the package is vacuum-sealed hermetically. After connections 17 and 23 have been brought into communication with the ambient air, the vacuum member 22 and the cover 20 of the chamber can be removed and the package can be removed from the bag 18 and holder 10. Then a next vacuum-package can be made in the same manner.

Figure 5:
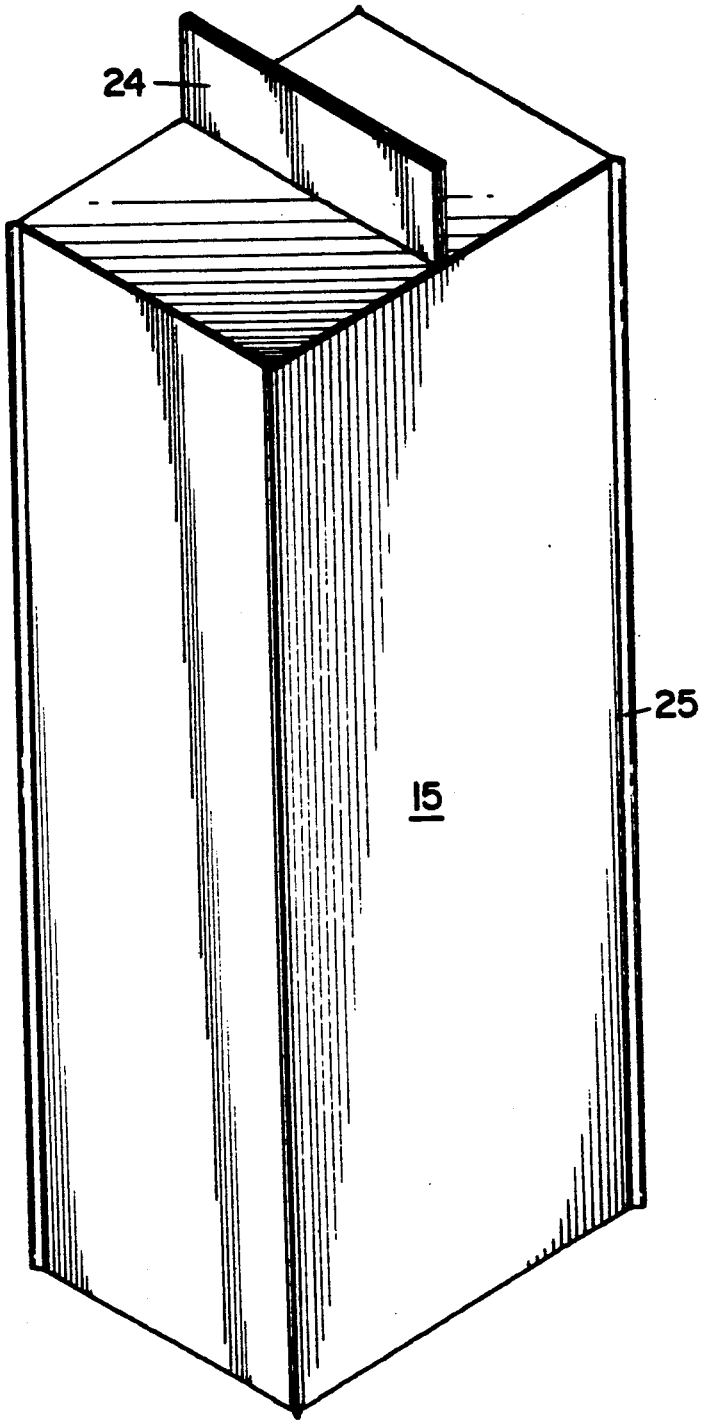
FIG. 5 shows the finished vacuum-package after it has been removed from the chamber.

Compared with a vacuum-package that has been made in similar manner, though not in accordance with the invention, the vacuum-package obtained in accordance with the invention has considerably flatter walls that do not deform any text or figures printed thereon. An additional advantage is that the package obtained, as shown in FIG. 5, acquires longitudinal fins 25 that strengthen the package at the corners where the package has not been supported by plates of the holder during compression.

Optionally, the vacuum-package can be checked for leakage directly after its production while it is still in the chamber closed off with cover 20 and the vacuum member 22 still arranged on the cover. For that purpose, connection 23 is brought into communication with the ambient air so that the pressure in the residual space between the package and the bag becomes atmospheric. Then, the communication between the connection 23 and the ambient air is interrupted so that the space under atmospheric pressure is completely closed off. The course of the pressure is now measured for a short time by a sensitive pressure gauge connected to connection 23. During this check for leakage, the air pressure on the bag is maintained, so that the bag with holder remains pressed against the package. The volume of the closed off space between the bag and the package is therefore very slight relative to the interior volume of the package. Even a very slight leak in the package will therefore manifest itself through a considerable pressure drop which demonstrates the presence of a leak in the package.

In the foregoing, the use of a separate holder for the package has been described. However, the side plates and the bottom of the holder, which may or may not be coupled to each other for movement relative to each other, can also be affixed permanently to the corresponding walls and the bottom of the bag, for instance by gluing.

What I claim is:

1. A method for making a vacuum-package filled with granular material, in which a package filled with granular material and made from a thin-walled and flexible packaging foil is placed in a holder surrounding a bottom and sidewalls of the package and comprising two pairs of flat, parallel opposite sidewalls and a bottom wall and the holder is placed in a casing, the casing comprising a flexible element having two paris of thin opposite sidewalls and a bottom, and in which a vacuum is applied to the packaged granular material and the package is subsequently vacuum-sealed hermetically, characterized in that the packaged granular material during at least part of the duration of the application of said vacuum is compressed by moving the flat and parallel walls of both pair of opposite sidewalls of the holder toward each other by moving both pairs of opposite sidewalls of the casing toward each other while maintaining an approximately parallel orientation of the respective opposite sidewall pairs of the holder against the package, and concurrently with the moving of the sidewalls of the holder toward each other, the bottom wall of the holder is moved toward a support member arranged at the top of the package by moving the bottom of the casing toward the support member.

2. A method according to claim 1 characterized in that the package is compressed after vacuumization of the package has been initiated.

3. A method according to claim 1 characterized in that the package is compressed concurrently with the initiation of the vacuumization of the package.

4. A method according to claim 1 characterized in that the package is first compressed and then, in compressed condition, vacuumized.

5. A method according to claim 1, characterized in that the package is maintained in compressed condition until a predetermined level of vacuum desired for the packaged material has been reached in the vacuum package.

6. A method according to claim 1, characterized in that the package is compressed by supplying compressed air externally of the casing so that the walls of the holder are moved inwardly.

7. A method according to claim 6, characterized in that said casing is designed as a double-walled bag placed in a chamber and the compressed air is supplied between the two walls of the bag.

8. A method according to claim 6, characterized in that after termination of the application of said vacuum to the package, the residual space between the hermetically closed package compressed by the holder and the casing fitting closely around the holder is brought into communication with atmospheric ambient air, this space is subsequently closed off from the atmospheric ambient air and the direction of any change of the pressure in this space is measured for a predetermined time for determining the possible presence of a leak in the package.

9. A method according to claim 7, characterized in that after termination of the application of said vacuum to the package, the residual space between the hermetically closed package compressed by the holder and the casing fitting closely around the holder is brought into communication with atmospheric ambient air, this space is subsequently closed off from the atmospheric ambient air and the direction of any change of the pressure in this space is measured for a predetermined time for determining the possible presence of a leak in the package.

10. An apparatus for making a vacuum-package, the package having two pairs of opposite sidewalls and a bottom, which package is made from thin-walled and flexible packaging foil, filled with granular material, comprising a holder provided with two pairs of flat, parallel opposite sidewalls, which holder having the sidewalls and a bottom wall surrounds the bottom and sidewalls of a package placed therein and filled with granular material, the holder fitting within a casing comprising a flexible element having two pairs of thin, opposite sidewalls movable toward each other and a bottom wall, a vacuum means for applying a vacuum sealing the package hermetically, characterized in that the flat and parallel walls of both pairs of opposite sidewalls of the holder are mounted for movement toward each other while maintaining an approximately parallel orientation of the respective opposite sidewalls of the holder and the bottom wall is mounted for movement upward toward a support member arrange at the top of the package, means for moving the sidewalls and the bottom wall of the casing toward the sidewalls and bottom wall of the holder for compressing the package during at least a part of the duration of application of the vacuum to the packaged granular material placed in the holder.

11. An apparatus according to claim 10, characterized in that the movable walls of the holder are interconnected for movement relative to each other.

12. An apparatus according to claim 11, characterized in that the holder is placed in the casing and compressed air means are arranged for supplying compressed air externally of the casing for moving the walls of the holder inwardly.

13. An apparatus according to claim 10, wherein the casing has an inside, characterized in that the holder is affixed to the inside of the casing.

14. An apparatus according to claim 12, characterized in that the casing is arranged in a chamber with an opening sufficient for containing said casing at one end, which chamber comprises a removable end plate for hermetically sealing the chamber when the holder and the package therein is placed in the casing, in which apparatus the compressed air means are connected to the chamber for supplying compressed air externally of the casing for moving inwardly the sidewalls of the holder and moving the bottom wall of the holder toward the support member, and the vacuum means is connected to the chamber for vacuumizing the space within the casing.

15. An apparatus according to claim 13, characterized in that the casing is arranged in a chamber with an opening sufficient for containing said casing at one end, which chamber comprises a removable end plate for hermetically sealing the chamber when the holder and the package therein is placed in the casing, in which apparatus compressed air means are connected to the chamber for supplying compressed air externally of the casing for moving inwardly the sidewalls of the holder and moving the bottom wall of the holder toward the support member, and the vacuum means is connected to the chamber for vacuumizing the space within the casing.

* * * * *

UNITED STATES PATENT AND TRADEMARK OFFICE

CERTIFICATE OF CORRECTION

PATENT NO. : 5,220,768

DATED : June 22, 1993

INVENTOR(S) : Mathias L. C. Aarts

It is certified that error appears in the above-identified patent and that said Letters Patent is hereby corrected as shown below:

On column 7, line 11, please delete "25" after the word "fins"

On column 7, line 52, please delete "paris" and substitute therefore --pairs--

On column 8, line 57 (claim 10), please insert --to the packaged granular material and sealing means for vacuum-- after the word "vacuum"

On column 8, line 64 (claim 10), please delete "arrange" and substitute therefore --arranged--

On column 9, line 20 (claim 14), please delete "the" after the word "apparatus"

Signed and Sealed this

Fifteenth Day of March, 1994

*Attest:*

*Attesting Officer*

Bruce Lehman

BRUCE LEHMAN

*Commissioner of Patents and Trademarks*